US007347035B2

(12) United States Patent
Predieri et al.

(10) Patent No.: US 7,347,035 B2
(45) Date of Patent: Mar. 25, 2008

(54) ASSEMBLY FOR AUTOMATICALLY UNROLLING AND CUTTING STRETCH FILM

(75) Inventors: Moreno Predieri, Rimini (IT); Giovanni Bevilacqua, Riccione (IT)

(73) Assignee: Noxon S.r.l., Rimini (IT)

( * ) Notice: Subject to any disclaimer, the term of this patent is extended or adjusted under 35 U.S.C. 154(b) by 0 days.

(21) Appl. No.: 10/535,544

(22) PCT Filed: Nov. 14, 2003

(86) PCT No.: PCT/IT03/00740

§ 371 (c)(1),
(2), (4) Date: May 18, 2005

(87) PCT Pub. No.: WO2004/045950

PCT Pub. Date: Jun. 3, 2004

(65) Prior Publication Data

US 2006/0130432 A1 Jun. 22, 2006

(30) Foreign Application Priority Data

Nov. 18, 2002 (IT) ..... FI2002A0225

(51) Int. Cl.
*B65B 53/00* (2006.01)
*B65B 61/06* (2006.01)

(52) U.S. Cl. ..... 53/556; 53/389.3; 53/389.4; 225/52

(58) Field of Classification Search ..... 53/556, 53/587–589, 389.3, 389.4; 83/649, 650, 83/949; 225/52; 242/579, 580, 598; *B65B 61/06; B65H 23/08*

See application file for complete search history.

(56) References Cited

U.S. PATENT DOCUMENTS

| | | | | |
|---|---|---|---|---|
| 2,636,654 | A * | 4/1953 | Sykes | 53/389.3 |
| 3,250,053 | A * | 5/1966 | Hyer et al. | 53/66 |
| 3,367,221 | A * | 2/1968 | Schmermund | 83/88 |
| 3,385,026 | A * | 5/1968 | Schmermund | 53/228 |
| 4,204,377 | A | 5/1980 | Lancaster et al. | 53/399 |
| 4,418,510 | A * | 12/1983 | Lancaster et al. | 53/399 |
| 4,509,314 | A * | 4/1985 | Bozza | 53/586 |

(Continued)

FOREIGN PATENT DOCUMENTS

DE 4124239 A1 * 9/1992

(Continued)

*Primary Examiner*—Stephen F. Gerrity
(74) *Attorney, Agent, or Firm*—Pollack, P.C.

(57) ABSTRACT

An assembly is disclosed for unrolling and pre-stretching stretch film as the film is fed from the assembly to goods/products to be wrapped or packed. The assembly comprises a first member for controlling the unwinding of the film from a spool, and a cutter arranged downstream of the control member for lacerating the film, the assembly further comprising a second member, downstream of the cutter, for preventing return of the film in a direction opposite to that in which the film leaves the assembly. A cutting procedure, according to another aspect of the present invention, comprises the steps of: following an initial stop of the film during which it is cut, the first, control member is unlocked so as to permit the laceration zone of the film to pass downstream of the second, return preventing member. The film then comes to a new stop to complete the cut following relative motion between the assembly and the goods/products to be wrapped or packed.

12 Claims, 6 Drawing Sheets

U.S. PATENT DOCUMENTS 4,597,516 A * 7/1986 Mayhall et al. ..... 226/154
4,765,120 A * 8/1988 Phillips ..... 53/441
5,081,824 A * 1/1992 Thimon et al. ..... 53/556
5,179,815 A * 1/1993 Cahill et al. ..... 53/133.3
5,408,808 A * 4/1995 Masuda et al. ..... 53/556
5,447,009 A * 9/1995 Oleksy et al. ..... 53/399
5,452,566 A 9/1995 Benhamou et al. ..... 53/556
5,491,956 A * 2/1996 Donnelly et al. ..... 53/399
5,572,850 A * 11/1996 Lancaster et al. ..... 53/399
5,765,344 A * 6/1998 Mandeville et al. ..... 53/441
5,930,975 A * 8/1999 Espinosa et al. ..... 53/141
6,164,047 A 12/2000 Rossi ..... 53/587
7,155,884 B2 * 1/2007 Cousins et al. ..... 53/556

FOREIGN PATENT DOCUMENTS

EP 136982 A1 * 4/1985
GB 0832247 4/1960
WO WO 02083501 10/2002

* cited by examiner

ASSEMBLY FOR AUTOMATICALLY UNROLLING AND CUTTING STRETCH FILM

FIELD OF THE INVENTION

The present invention relates generally to packaging and, more particularly, to systems and methods for wrapping using stretch film or the like.

BACKGROUND OF THE INVENTION

Conventional apparatus, whether stationary or mobile, for packing goods/products using stretch film typically comprise an assembly for unrolling or dispensing the film from a spool and then pre-stretching the same. The assembly feeds the film toward a bundle of goods/products to be wrapped/packed, the bundle usually being supported by a pallet. The spool is unrolled using rubber-covered rollers controlled either by electromagnetic brakes or clutches, or through electronically operated motor reducers. The film then passes over a series of idle conveyance rollers before leaving the assembly and arriving at the bundle to be wrapped.

With a stationary or fixed type apparatus installation, the bundle, which is arranged on an appropriate platform, rotates about its own axis. With mobile apparatus, on the other hand, it is the unrolling and pre-stretching assembly that causes rotation about the bundle, which remains in a fixed position. Rotation of the rubber-covered rollers is often controlled by varying the voltage supply, when electromagnetic brakes or clutches are used, or the number of revolutions in the case of electronically operated motor reducers, holding the stretch film back to a greater or lesser extent, and thus regulating its "stretch" as it is fed. The elastic return then assures stability during the film's wrapping about the bundle.

At the end of the wrapping cycle, the film is cut, either manually by the operator or using an automatic cutter arranged generally downstream of the rollers. When operating the cutter, an initial laceration is made so as to develop transversely into a complete cut by locking the control rollers and then continuing relative rotational movement between the assembly and the bundle. In this manner, the terminal or end flap of film, which is left upon laceration, remains attached to the wrapped bundle or package formed.

Although the above-described arrangements have been found useful, when the film is torn, however, because of the effect of the elastic return of the material, the flap upstream of the cut tends to return into the assembly. As a result, the flap often becomes disengaged from the rollers, necessitating that flap be manually re-positioned on the rollers before resuming operations for the next wrapping cycle. This has been found not only inconvenient and annoying, but also causes substantial loss of time and, therefore, considerable reduction in productivity during wrapping/packing operations.

Furthermore, when the automatic cutter is used, it has been found that development of the cut, and its final position relative to the length of film that has been pulled from the assembly, cannot be accurately controlled. Because a substantial portion of film extends freely downstream of the point where the film is restrained, a tail of film is usually formed that, upon completion of the cut, will dangle from the wrapped/packed bundle in an awkward and tedious fashion. Tail formation also results from the critical angles at which, and the tensions under which, the film often leaves the assembly.

OBJECTS AND SUMMARY OF THE INVENTION

Accordingly, it is an object of the present invention to provide a stretch film unrolling and pre-stretching assembly having an automatic film cutter that allows relatively continuous packing operations without requiring adjustment of the assembly or otherwise necessitating a worker's intervention at the end of the cutting operation to insure suitable re-positioning of the film for the next wrapping cycle.

Another object of the present invention is to provide a stretch film unrolling and pre-stretching assembly that allows more accurate control of the final position of the cut in the film, thereby avoiding the formation of tails of film on the goods or products being wrapped/packed.

According to one aspect of the present invention, an assembly is provided for unrolling and pre-stretching stretch film, the assembly comprising a first member for controlling forward movement of the film as it is unrolled from a spool, a cutter, arranged downstream of the control member, for lacerating the film, and a second member, arranged generally downstream of the cutter, for preventing return of the film in a direction opposite to that in which the film leaves the assembly.

In accordance with another aspect of the present invention, a method is provided for cutting strech film fed by and from an assembly for unrolling and pre-streching the film toward goods/products to be wrapped. The assembly includes a first member for controlling the unwinding of the film from a spool and a cutter for selectively severing the film. The method comprises the steps of initially bringing the film to a halt by locking the control member, and simultaneously operating the cutter so as to lacerate the film. Upon completion of the cut-due to stretching of the film following the wrapping movement, the control member is unlocked so as to permit the lacerated portion of the film to pass generally downstream of a member for preventing the return of the film in the direction opposite the one in which it leaves the assembly, the film then being brought to a halt by the control member in order to complete the cut.

BRIEF DESCRIPTION OF THE DRAWINGS

A specific, illustrative assembly and method for automatically unrolling and cutting stretch film, in accordance with the present invention, is described below with reference to the accompanying drawings, in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
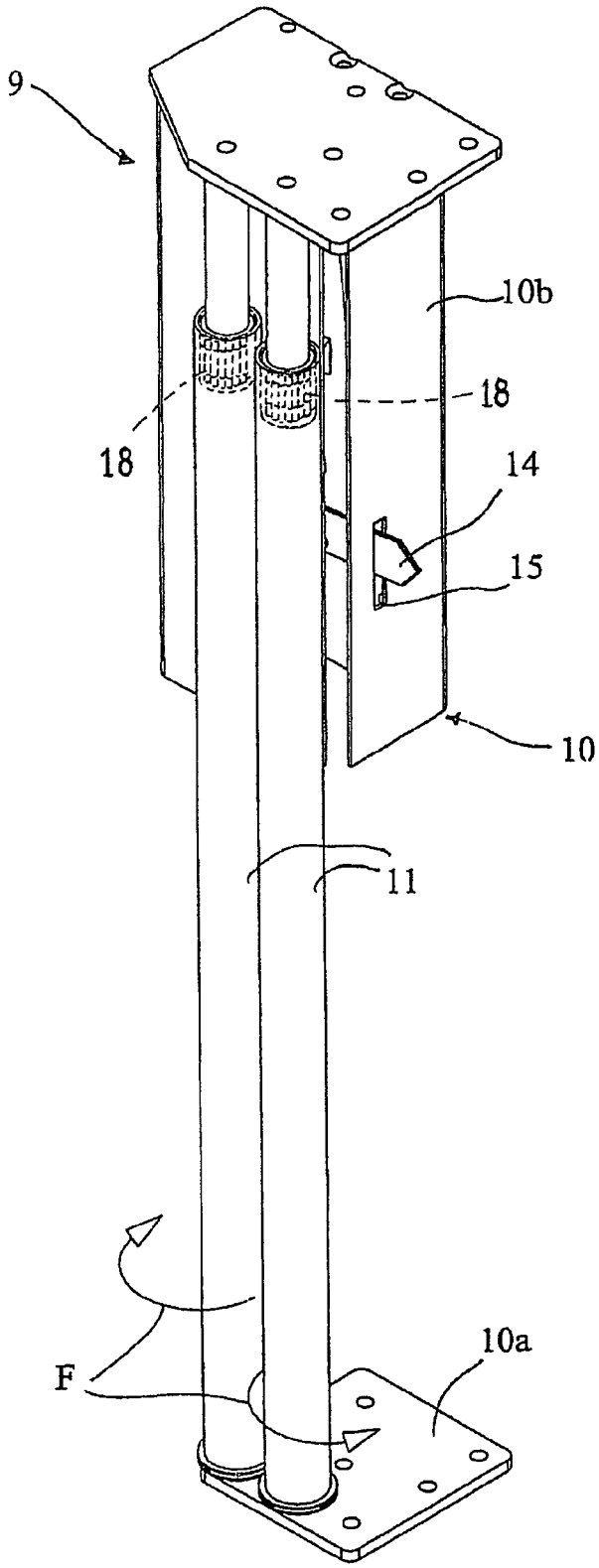
FIG. 1 is a perspective view of a cutting device of an assembly for automatically unrolling and cutting stretch film, in accordance with present invention.

Referring now to the drawings and, more particularly, to FIGS. 1-4, there is shown generally a specific, illustrative assembly for automatically unrolling and cutting stretch film, in accordance with various aspects of the present invention. According to one embodiment illustrated throughout this disclosure, a stretch film unrolling and pre-stretching assembly is provided, in accordance with the invention, as part of a conventional packaging machine. Functional and structural aspects of such packaging machines are considered known by those skilled in the art and further description is believed unnecessary for illustration of the present invention.

Figure 6:
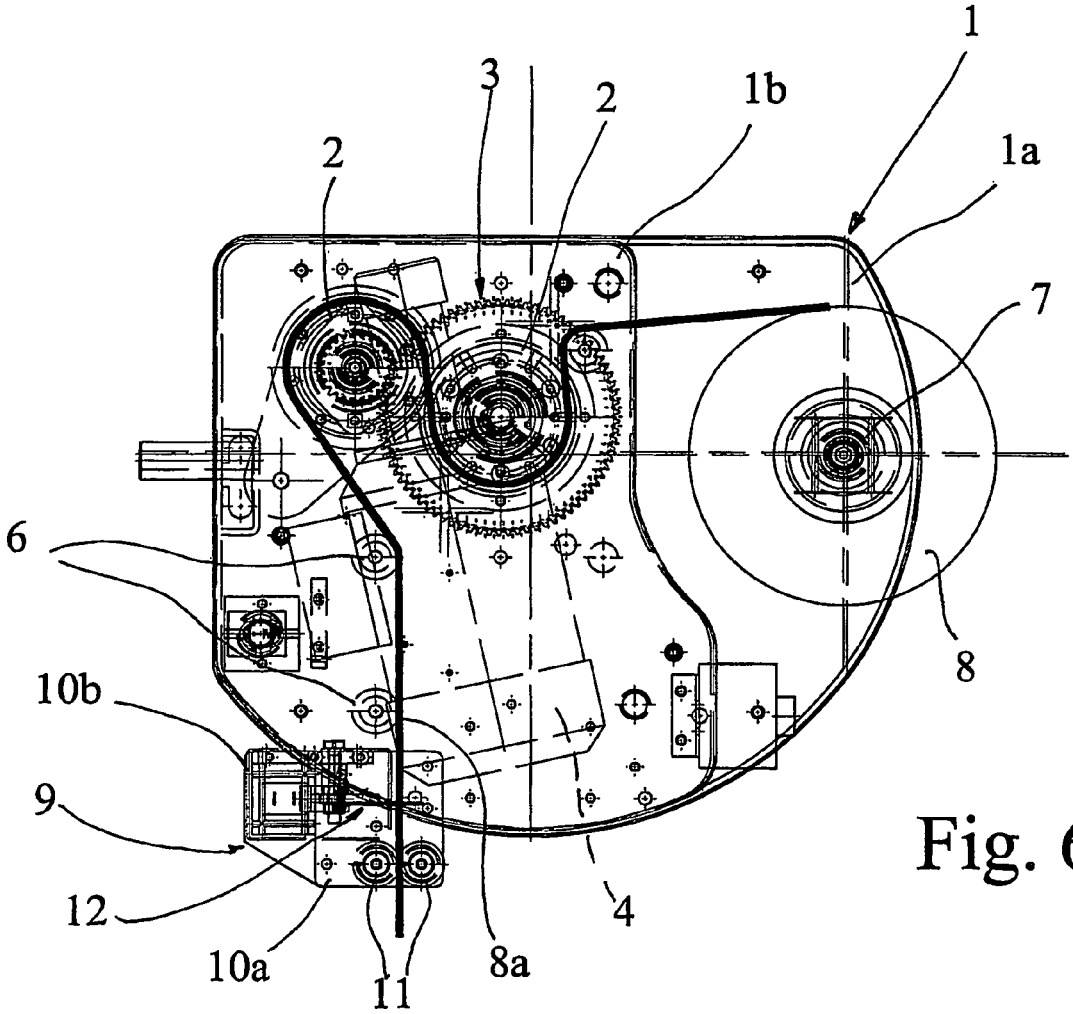
FIG. 6 is a plan view of the assembly shown in FIGS. 4 and 5.

For purposes of the present invention as set forth herein, the machine preferably includes a frame 1, comprising a lower plate 1*a* and a top casing 1*b* at a selected distance from one another, and rollers 2, e.g., rubber-covered, extending between them for controlling forward movement of the film. The rollers are operated through transmission 3 by a motor reducer 4, shown by broken lines in FIG. 6, accommodated within casing 1*b*. Also illustrated are idle conveyance rollers 6 arranged generally downstream of the rubber-covered rollers, and a support 7 for a spool of film 8, best seen in FIG. 6, where a film path 8*a* is additionally shown, unwound from spool 8, across control rollers 2 and idle conveyance rollers 6 to exit the assembly.

Figure 2:
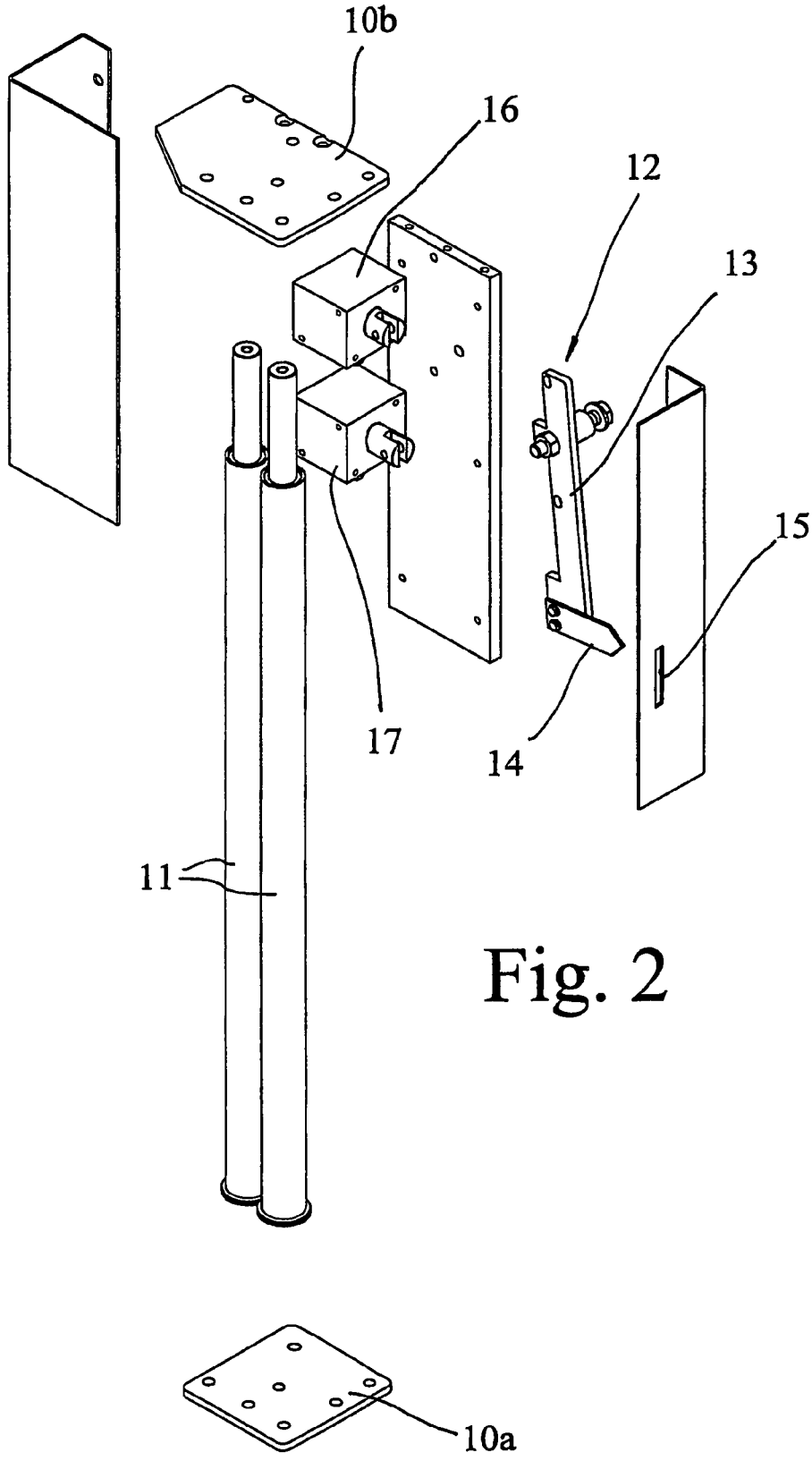
FIG. 2 is an exploded view of the cutting device shown in FIG. 1.

Referring now further to FIGS. 1-3, downstream of the conveyance rollers 6 and in a zone where the film leaves the unrolling and pre-stretching assembly, a frame 1 is provided which supports a film cutting device 9 that likewise extends between lower plate 1*a* and top casing 1*b*. Device 9, in turn, comprises a frame 10 having a lower plate 10*a* and a top casing 10*b*, between which two rubber-covered rollers 11 extend. The rollers are preferably arranged in contact with one another so as to engage and allow the film to pass between them. The forward motion of the film leaving the assembly causes the rollers, e.g., two rollers that are relatively small in size, to rotate in opposite directions, indicated by arrows F in FIG. 1.

The rollers preferably include a system for preventing their rotation in a direction opposite to that which corresponds to the film leaving the assembly. This effect may be achieved with any known system, for example, by mounting the rollers on their respective fixed axes of rotation using, for instance, drawn cup roller clutches 18, shown in dashed lines in FIG. 1. Upstream of rollers 11, and inside top casing 10*b* of frame 10, a film cutting mechanism 12 is housed as shown, for example, in FIGS. 2, 3*a* and 3*b*. Mechanism 12 desirably comprises a blade 14 supported by an arm 13 hinged in an intermediate position so as to undergo an angular displacement in a plane crossing the plane in which the film lies as it leaves the assembly.

Figure 3A:
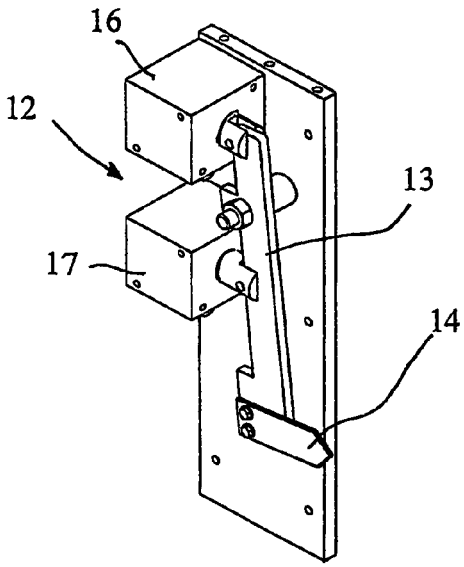
FIG. 3*a* is detail view of a film cutting blade of the device shown in FIG. 1 in a cutting or operative position.

More specifically, a blade 14 projects transversely from one end of arm 13, i.e., the lower end in the configuration shown, so as to partially project from or outside of casing 10*b*, the blade passing through a slot 15 formed in the casing, so that it may cut the film following a selected rotation of arm 13 towards a cutting position (see FIG. 3*a*). On the other hand, rotation of the arm in an opposite direction, towards a resting position (shown in FIG. 3*b*), causes blade 14 to return inside the case, leaving the film free to move forward towards rollers 11, without interference.

Figure 3B:
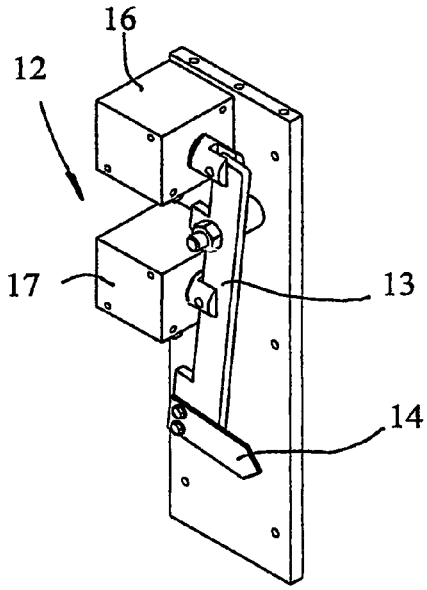
FIG. 3*b* is a detail view of the film cutting blade of FIG. 3*a* in a rest or stowed position.
Figure 4:
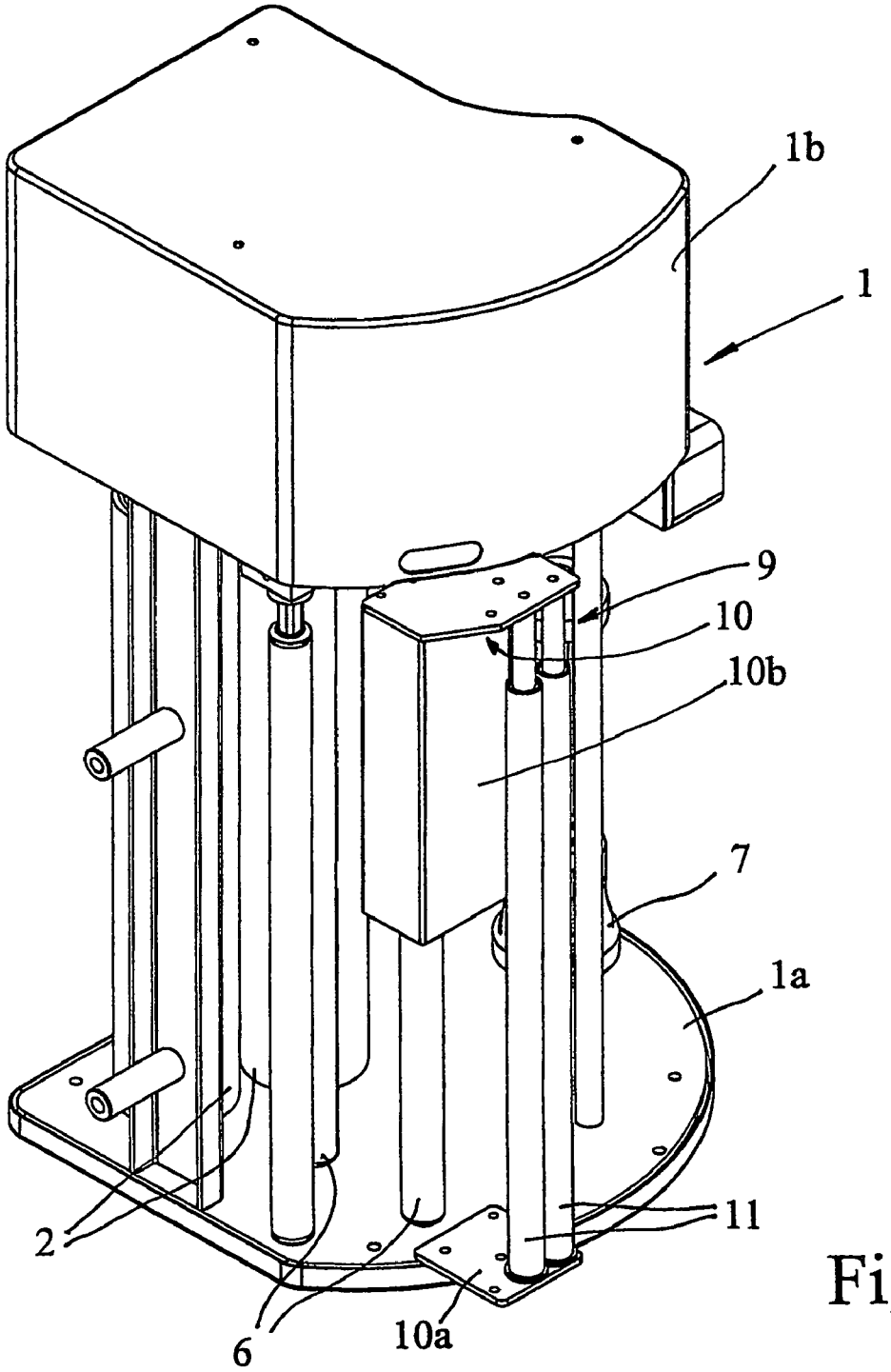
FIG. 4 is a perspective view of an assembly for automatically unrolling and cutting stretch film, in accordance with another aspect of the present invention.
Figure 5:
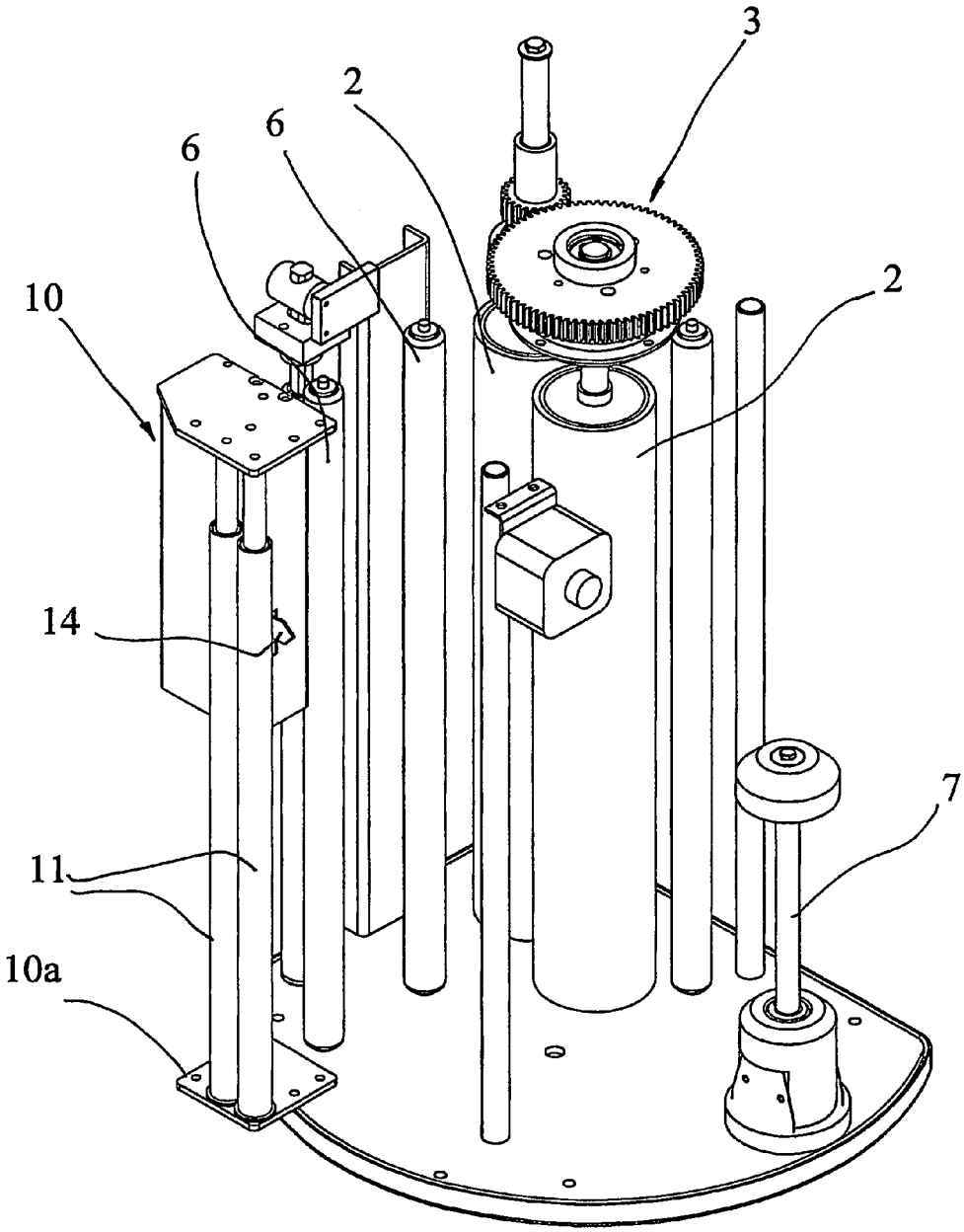
FIG. 5 is an alternative perspective view of the assembly shown in FIG. 4 with its top casing removed.

The cutting mechanism also includes an actuator for effecting rotation of arm 13. In the embodiment illustrated, the actuator comprises a pair of linear electro-magnetic actuators 16, 17 acting, respectively, on an upper end of arm 13, opposite that which bears blade 14, and at a point relatively intermediate between the blade and the hinge point of the arm. As best seen in FIGS. 3*a* and 3*b*, an operative or cutting position of the arm is defined generally by a backward configuration of upper actuator 16 and a forward configuration of lower actuator 17. A stowed or resting position, on the other hand, is determined by corresponds generally with a forward configuration of the upper actuator and a backward configuration of the lower actuator. Actuators 16 and 17 are desirably controlled by an electronic control system of the packaging machine, e.g., conventional, with which the present invention may be used. It is preferred that such system also control operation of motor reducer 4 and; thus, rollers 2.

Generally speaking, the procedure for wrapping stretch film about the bundle to be wrapped/packed using the assembly in accordance with the present invention may be accomplished in a conventional manner due to the effect of mutual rotation between the assembly and the bundle being wrapped/packed. During a normal feeding operation, the film leaving the assembly passes between rubber-covered rollers 11, such rollers rotating in opposite directions, and arm 13 being maintained in a resting position. As a wrapping cycle for a bundle comes to an end, rollers 2 are locked for a selected time, which may vary depending on the circumstances, thereby bringing forward movement of the film to a halt. At the same time, arm 13 is brought into its cutting position, so that blade 14 causes a perforation of the film, after which the blade is immediately returned to its resting position.

Thereafter, rollers 2 are unlocked to cause the film to move forward, thus permitting the film's perforation zone to move downstream of and away from rollers 11. At this point, after another selected interval of time, that may be arbitrarily determined, rollers 2 are locked once more, thereby again bringing the film to a halt. Since the relative movement between the assembly and the load to be wrapped continues, the film downstream of the point at which it is restrained becomes considerably stretched. The perforation will thus rapidly develop into a relatively complete transverse cut. The wrapping cycle may then terminate. Since rollers 11 are not able rotate in a direction opposite the one in which the film leaves the assembly, they prevent the flap of film from shrinking into the interior of the assembly due to the elastic return effect following the cut. The flap is, therefore, redily and securely accessible for the operator to commence the next wrapping cycle.

Hence, rather than proceeding immediately with cutting the film and allowing the lacerated portion to drop, the control member is released to permit the lacerated portion to pass downstream of a second member for preventing return of the film. Generally speaking, and preferably, it is only at this point that the film is again brought to a halt and the cut completed. In this manner, the film is restrained at a point immediately upstream of the cutting zone, while being restrained simultaneously at a point in proximity to the outlet of the assembly, thereby enhancing control of the final position of the cut.

In addition to overcoming drawbacks of conventional assemblies for unrolling and cutting stretch film, the present invention notably achieves highly effective control of the development of the cut. Indeed, rollers 11 provide the film with an added point of retraint in the outlet zone, preventing the cut from assuming an unpredictable position, in general, and formation of a long tail of film dangling from the wrapped products/goods, in particular. Morover, the present invention advantageously enhances accident prevention and safety of the cutting system, since rollers 11 prevent access from the outside to the zone in which blade 14 operates. Finally, as the entire film cutting device 9 is a single body distinct from the rest of the assembly, it is particularly beneficial in being easily removed from the assembly for maintenance and/or repair.

Furthermore, the assembly according to the present invention can be readily used in any semi-automatic machine for wrapping pallets or various products.

Although the present invention has been shown and described as having control rollers 2 with associated motor reducer 4, those skilled in the art will appreciate that other control arrangements may be utilized, giving consideration to the purpose for which the invention is intended. For instance, rollers 2 and motor reducer 4 could be replaced by an alternative control system in accordance with what is known in the art. Similarly, constructions different from that described above could be used to operate the blade (for example, a pneumatic or purely mechanical system), though the solution disclosed is considered particularly advantageous on in view of its structural and functional simplicity. More specifically, the characteristic double movement of arm 13 by two actuators 16, 17 insures precise, safe, and reliable arm movement.

The invention claimed is:

1. An assembly for unrolling stretch film from a spool and pre-stretching the film as the film is fed from the assembly towards goods/products to be wrapped, the assembly comprising a first member for controlling forward movement of the film downstream of the spool in a direction in which the film leaves the assembly, a cutter for lacerating the film, arranged downstream of the control member,and a second member, arranged generally downstream of the cutter, for preventing return of the film in a direction opposite to that in which the film leaves the assembly; wherein the cutter comprises an arm hinged at an intermediate hinge position so as to enable angular displacement in a plane crossing the plane in which the film lies while leaving the assembly, a blade projecting transversely from one end of the arm, the arm being movable angularly between an operative position, in which the blade perforates the film, and a stowed position in which the blade does not interfere with the film, and an actuator for controlling angular displacement of the arm, and wherein the actuator has linear electromagnetic actuators acting on, respectively, an end of the arm opposite that which bears the blade and a point intermediate between the blade and the hinge position of the arm, such that the operative stowed positions are determined by appropriately opposite forward/backward configurations of the linear electromagnetic actuators.

2. The assembly set forth in claim 1, wherein the return preventing member comprises two rubber-covered rollers rotating in opposite directions, arranged in contact with one another so as to allow the film to pass there between and is provided with a system for preventing the rollers from revolving in the direction opposite to the direction in which the film leaves the assembly.

3. The assembly set forth in claim 2, wherein the rotation preventing system comprises drawn cup roller clutches on which the rollers are mounted.

4. The assembly set forth in claim 1, wherein the cutter and the return preventing member are supported by a frame that is detachable from the rest of the assembly.

5. The assembly set forth in claim 1, wherein the blade bearing arm and the actuator are housed by a casing, in which a slot is formed for allowing the blade to project at least partially from the casing in the cutting position.

6. A film unrolling and stretching assembly, which comprises:

a spool of stretch film;

a member for controlling forward movement of the film downstream of the spool in a direction in which the film leaves the assembly;

a cutter, arranged downstream of the control member, suitable to form in the film, after wrapping selected goods/products, a perforation zone having a limited extension in a direction along a transverse width of the film; and a film return preventing member located downstream of the cutter and arranged so as to pre-stretch the film during feeding of the film from the assembly toward the goods/products to be wrapped; wherein the film return preventing member engages the film generally continuously and has a system suitable for preventing return of the film, after formation of the perforation zone, passage of the perforation zone downstream of the film engagement member, and formation of a complete transverse cut, using an elastic return in a direction opposite to that in which the film leaves the assembly.

7. The assembly set forth in claim 6, wherein the return preventing member comprises rubber-covered rollers rotating in opposite directions, arranged in contact with one another so as to allow the film to pass there between, the return prevention system preventing the rubber-covered rollers from rotating in the direction opposite to that in which the film leaves the assembly.

8. The assembly set forth in claim 7, wherein the return prevention system comprises drawn cup roller clutches mounting the rollers.

9. The assembly set forth in claim 6, wherein the cutter and the return preventing member are supported by a frame that is detachable from the rest of the assembly.

10. The assembly set forth in claim 6, wherein the cutter comprises an arm hinged at an intermediate hinge position so as to undergo an angular displacement in a plane crossing the plane in which the film lies upon leaving the assembly, and a blade projecting transversely from one end of the arm, the arm being movable angularly between an operative position, in which the blade perforates the film, and a stowed position in which the blade does not interfere with the film, an actuator being provided for controlling the angular displacement of the arm.

11. The assembly set forth in claim 10, wherein the actuator comprises a pair of linear electromagnetic actuators acting on, respectively, an end of the arm opposite that which bears the blade and a point intermediate between the blade and the hinge position of the arm, so that the operative position and the stowed position are determined by appropriately opposite forward/backward configurations of the linear electromagnetism actuators.

12. The assembly set forth in claim 10, wherein the blade bearing arm and the actuator are housed by a casing, in which a slot is formed for allowing the blade to project at least partially from the casing in the cutting position.

* * * * *